US007124736B2

(12) United States Patent
Kondo et al.

(10) Patent No.: US 7,124,736 B2
(45) Date of Patent: Oct. 24, 2006

(54) IDLING OPENING DEGREE CONTROL APPARATUS IN INTAKE AIR CONTROL APPARATUS

(75) Inventors: Yasushi Kondo, Kawasaki (JP); Tomio Hirabayashi, Kawasaki (JP)

(73) Assignee: Kehin Corporation, Tokyo (JP)

( * ) Notice: Subject to any disclaimer, the term of this patent is extended or adjusted under 35 U.S.C. 154(b) by 44 days.

(21) Appl. No.: 11/106,153

(22) Filed: Apr. 14, 2005

(65) Prior Publication Data

US 2005/0235954 A1 Oct. 27, 2005

(30) Foreign Application Priority Data

Apr. 23, 2004 (JP) ..... 2004-128352

(51) Int. Cl.
*F02M 3/00* (2006.01)
*F02D 11/10* (2006.01)

(52) U.S. Cl. ..... 123/339.14; 123/339.13; 123/339.26; 123/400

(58) Field of Classification Search ..... 123/339.13, 123/339.14, 339.26, 398, 400, 337
See application file for complete search history.

(56) References Cited

U.S. PATENT DOCUMENTS 4,787,353 A * 11/1988 Ishikawa et al. ..... 123/399
6,581,567 B1 * 6/2003 Deguchi ..... 123/336
6,691,680 B1 * 2/2004 Saito ..... 123/399
6,761,145 B1 * 7/2004 Matsuda et al. ..... 123/342
6,868,828 B1 * 3/2005 Kondo ..... 123/339.26
6,964,259 B1 * 11/2005 Raetzman ..... 123/400

FOREIGN PATENT DOCUMENTS

JP 2005-307912 * 11/2005

* cited by examiner

*Primary Examiner*—Hai Huynh
(74) *Attorney, Agent, or Firm*—R. Neil Sudol; Henry D. Coleman; William J. Sapone

(57) ABSTRACT

To make a motor to control throttle valve opening degree compact and reduce electricity consumption, a throttle valve lever (4) attached to a throttle valve shaft (3) has a roller (4*b*) and an operating arm portion (4*a*), a loosely fitted lever (8) is arranged to the throttle valve shaft (3), the operating arm portion (4*a*) is arranged in a gap (S) between first and second locking portions (8*a*1, 8*a*2) of the loosely fitted lever (8), a cam surface (7*a*) of a cam lever (7) connected to an output shaft (Ma) of a lead screw type step motor (M) faces to the roller (4*b*), a throttle valve operating drum (11) is coupled to the loosely fitted lever (8) via a link cover (13) and, when the motor (M) is driven, the cam lever (7) rotates the throttle valve lever (4) and the arm portion (4*a*) rotates within the gap (S) to hold an idling opening degree.

3 Claims, 4 Drawing Sheets

IDLING OPENING DEGREE CONTROL APPARATUS IN INTAKE AIR CONTROL APPARATUS

TECHNICAL FIELD

The present invention relates to an intake air control apparatus for controlling an amount of air supplied to an engine, and particularly to an idling opening degree control apparatus in an intake air control apparatus in which a throttle valve shaft is rotatably arranged across an intake passage extending through an inner side of a control main body, and a throttle valve is attached to the throttle valve shaft so as to control to open and close the intake passage.

Background Art

A description will be given of a conventional idling opening degree control apparatus in an intake air control apparatus with reference to FIG. 4. Reference numeral 50 denotes a control main body in which an intake passage 51 is provided so as to extend through an inner portion. A throttle valve shaft 52 is arranged across the intake passage 51, and the throttle valve shaft 52 is rotatably pivoted to the control main body 50. Reference numeral 53 denotes a butterfly type throttle valve arranged within the intake passage 51 and attached to the throttle valve shaft 52. An opening area of the intake passage 51 is controlled so as to open and close on the basis of a rotation of the throttle valve 53.

Further, the throttle valve shaft 52 is arranged so as to protrude from the control main body 50, and a throttle valve lever 54 is arranged so as to be firmly fixed to a protruding end portion of the throttle valve shaft 52.

One end of a throttle valve return spring 55 is engaged to the throttle valve lever 54, whereby a rotating force in a closing direction of the throttle valve 53 (a counterclockwise direction in the drawing) is applied to the throttle valve lever 54. (The other end of the throttle valve return spring 55 is engaged to a control main body 50.) Reference numeral 56 denotes a minimum opening degree control member formed by a screw member. A leading end portion thereof is arranged so as to face to an end surface of the throttle valve lever 54.

The minimum opening degree control member holds a minimum idling operation (for example, 560 revolutions per minute) at a minimum revolution speed of an engine.

Reference numeral 57 denotes a throttle valve operating drum firmly fixed to a drum shaft 58*b* rotatably supported to the control main body 50. A cam lever 58 having a cam surface 58*a* is integrally formed in the throttle valve operating drum 57.

The throttle valve operating drum 57 and the cam lever 58 are synchronously rotated. Reference numeral 59 denotes a drum return spring applying a spring force in a counterclockwise direction to the throttle valve drum 57. One end of the drum return spring 59 is engaged to the throttle valve operating drum 57, and the other end thereof is engaged to the control main body 50.

Further, a valve opening wire Wa and a valve closing wire Wb are engaged to the throttle valve operating drum 57. When a driver draws the valve opening wire Wa, the throttle valve operating drum 57 is rotated in a clockwise direction, and the throttle valve operating drum 57 is rotated in the counterclockwise direction by drawing the valve closing wire Wb.

Reference numeral 60 denotes an idle adjust screw for adjusting the throttle valve 53 to keep a normal idling operation (for example, 720 revolutions per minute). The idle adjust screw 60 is screwed with the control main body 50, and a leading end portion 60*a* thereof is arranged so as to be brought into contact with an arm portion 57*a* of the throttle valve operating drum 57.

Reference numeral 61 denotes a first idle lever rotatably supported to the shaft 62. A roller 61*a* provided in the first idle lever 61 is arranged so as to face to the cam surface 58*a* of the cam lever 58.

Further, the throttle valve operating drum 57 and the throttle valve lever 54 are connected via a link lever 62, a right end of the link lever 62 is connected to the throttle valve operating drum 57 via a first link shaft 63*a*, and a left end of the link lever 62 is connected to the throttle valve lever 54 via a second link shaft 63*b*.

In accordance with the conventional intake air control apparatus mentioned above, the normal idling opening degree of the throttle valve 53 for keeping the normal idling operation (for example, 720 revolutions per minute) is set by rotating the idle adjust screw 60.

In other words, when a position of the leading end 60*a* of the idle adjust screw 60 is adjusted and determined by rotating the idle adjust screw 60, a rotational position of the throttle valve operating drum 57 is determined by the arm portion 57*a* brought into contact therewith, and the rotational position is transmitted to the throttle valve lever 54 via the link lever 62 so as to determine a rotational position of the throttle valve lever 54, whereby the throttle valve 53 can be set to the normal idling opening degree.

Accordingly, a gap is formed between the leading end 56*a* of the minimum opening degree control member 56 and the end surface 54*a* of the throttle valve lever 54, at a time of the normal idling opening degree of the throttle valve 53 mentioned above.

Further, the roller 61*a* of the first idle lever 61 and the cam surface 58*a* of the cam lever 58 are not brought into contact with each other, but form a gap.

Then, a description will be given of a case that a first idling operation (for example, 1200 revolutions per minute) is executed by increasing an amount of air supplied to the engine more than an amount of air supplied for the normal idling operation, at a time of starting the engine under a low temperature. The first idle lever 61 is mechanically or electrically drawn and is rotated in a counterclockwise direction in the drawing.

In accordance with the rotation of the first idle lever 61 in the counterclockwise direction, the roller 61*a* is brought into contact with the cam surface 58*a* of the cam lever 58, thereby rotating the cam lever 58 in the clockwise direction in the drawing, and the throttle valve operating drum 57 is also rotated in the clockwise direction synchronously with the cam lever 58.

Further, the rotation of the throttle valve operating drum 57 in the clockwise direction is transmitted to the throttle valve lever 54 via the link lever 62 so as to rotate the throttle valve lever 54 in the clockwise direction, and the throttle valve 53 holds the first idling opening degree which is further opened from the idling opening degree in correspondence to the rotation of the throttle valve opening drum 57.

On the other hand, as for the opening operation of the throttle valve 53, the throttle valve 53 can be opened in correspondence to the rotation of the throttle valve opening drum 57 by drawing the valve opening wire Wa so as to rotate the throttle valve operating drum 57 in the clockwise direction in the drawing, by transmitting the rotation of the throttle valve operating drum 57 to the throttle valve lever 54 via the link lever 62, and by rotating the throttle valve lever 54 in the clockwise direction.

As for the closing operation of the throttle valve 53, the throttle valve 53 can be closed in correspondence to the rotation of the throttle valve operating drum 57 by drawing the valve closing wire Wb so as to rotate the throttle valve operating drum 57 in the counterclockwise direction in the drawing, by transmitting the rotation of the throttle valve operating drum 57 to the throttle valve lever 54 via the link lever 62, and by rotating the throttle valve lever 54 in the counterclockwise direction.

In this case, when drawing down the idle adjust screw 60 so that the leading end portion 60*a* of the idle adjust screw 60 separates from the arm portion 57*a* of the throttle valve operating drum 57, the end surface 54*a* of the throttle valve lever 54 is brought into contact with the leading end 56*a* of the minimum opening degree regulating member 56, whereby it is possible to keep the minimum idling opening degree at which the minimum idling operation without engine stop can be executed.

In accordance with the conventional idling opening degree control apparatus mentioned above, it is necessary to apply a tensile force larger than a total spring force of a spring force of the drum return spring 59 and a spring force of the throttle valve return spring 55 to the first idle lever 61 at a time of opening the first idle lever 61.

Accordingly, when operating the first idle lever 61 by an electric motor such as an electromagnetic apparatus, a step motor or the like, the electric motor is increased in size or a current consumption is increased.

This matter is not preferable in the structure of particularly the two-wheel vehicle, in which the receiving space is limited or an electric capacity is small in comparison with the motor vehicle.

Further, the rotation of the first idle lever 61 is transmitted to the throttle valve lever 54 from the cam lever 58 and the throttle valve operating drum 57 via the link 62. It is hard to keep the accurate first idle opening degree of the throttle valve 53 with respect to the rotation of the first idle lever 61 particularly due to the influence of dispersion and play of the fitting portion between the first link shaft 63*a* and the second link shaft 63*b* of the link lever 62 and the hole supporting the shafts.

Further, at a time of closing operation of the throttle valve operating drum 57 toward a full-close state (toward the first idle opening degree) from an open state with high opening degree, under a state of the first idle lever 61 being in the first idle opening degree operation, the cam surface 58*a* of the cam lever 58 is brought into contact with the roller 61*a* with a strong impact force. Accordingly, there is a risk that an abrasion is generated between the cam surface 58*a* and the roller 61*a*, and a lot of development work man-hour is required for selecting materials of the cam surface 58*a* and the roller 61*a*, in order to inhibit the abrasion and improve a rigidity.

SUMMARY OF THE INVENTION

An idling opening degree control apparatus in accordance with the present invention is made by taking the problems mentioned above into consideration, and a first object of the present invention is to provide an idling opening degree control apparatus in which an electric motor such as an electromagnetic apparatus, a step motor or the like is made compact and an electric power consumption is reduced by reducing an opening operation force of a cam lever (corresponding to the first idle lever in the conventional structure) operated for keeping a first idling opening degree of a throttle valve, thereby achieving an excellent mounting property on a two-wheel vehicle.

Further, a second object of the present invention is to provide an idling opening degree control apparatus which can accurately transmit an operation of the electric motor to a throttle valve lever with no dispersion, and can stably keep an accurate first idling opening degree of the throttle valve in correspondence to an operation stroke of the electric motor.

In order to achieve the object mentioned above, in accordance with a first aspect of the present invention, there is provided an idling opening degree control apparatus in an intake air control apparatus in which an intake passage provided through in a control main body is opened and closed by a throttle valve attached to a throttle valve shaft rotatably pivoted to the control main body, comprising:

a throttle valve lever firmly fixed to a throttle valve shaft and synchronously rotating with the throttle valve shaft;

a loosely fitted lever rotatably arranged in the throttle valve shaft in a loose fit manner;

a throttle valve operating drum rotatably supported to a drum shaft and operated so as to be opened and closed by a driver; and a cam lever rotatably pivoted to a cam shaft and rotating in correspondence to a movement in an axial direction of a lead screw type step motor, wherein the throttle valve operating drum and the loosely fitted lever are coupled via a link lever, wherein an operating arm portion formed in the throttle valve lever is arranged so as to face to an opposing gap between a first locking portion and a second locking portion in a forked locking portion formed in the loosely fitted lever and a cam surface of the cam lever is arranged so as to face to a roller provided in the throttle valve lever, wherein the operating arm portion of the throttle valve lever is moved within the opposing gap between the first locking portion and the second locking portion in the forked locking portion by the cam lever, thereby keeping an idling opening degree or a first idling opening degree of the throttle valve, at a time of operating the lead screw type stepping motor, and wherein the throttle valve is opened by bringing the first locking portion of the loosely fitted lever into contact with the operating arm portion of the throttle valve lever, at a time of operating the throttle valve operating drum in an opening direction.

Further, in accordance with a second aspect of the present invention, there is provided an idling opening degree control apparatus as recited in the first aspect mentioned above, wherein a loosely fitted lever spring pressing the operating arm portion of the throttle valve lever toward the first locking portion of the loosely fitted lever is provided compressedly between the throttle valve lever and the loosely fitted lever.

Further, in accordance with a third aspect of the present invention, there is provided an idling opening degree control apparatus as recited in the first aspect mentioned above, wherein the drum shaft, the throttle valve shaft and the cam shaft are supported by the control main body.

In accordance with the first aspect of the present invention, when the lead screw type step motor is activated, the cam lever is rotated in a clockwise direction, and the rotation is transmitted to the roller via the cam surface, and the throttle valve lever is rotated in the clockwise direction in correspondence to a stroke of the cam surface, whereby it is possible to hold the first idling opening degree of the throttle valve in correspondence to a moving stroke of the lead screw type step motor.

When the throttle valve lever is rotated in the clockwise direction by the lead screw type step motor, the operating arm portion of the throttle valve lever moves within the opposing gap formed between the first locking portion and the second locking portion in the forked locking portion of the loosely fitted lever.

In accordance with the structure mentioned above, since it is sufficient that a pressing force of the lead screw type step motor with respect to the throttle valve lever is capable of overcoming the sprig force of the throttle valve return spring, it is possible to make the lead screw type step motor compact, and it is possible to reduce the electric power consumption, whereby it is possible to provide the idle opening degree control apparatus preferable for the two-wheel vehicle.

Further, since the moving stroke of the reed screw type step motor is directly transmitted to the roller of the throttle valve lever from the cam surface of the cam lever without interposition of the other members such as the link lever or the like, the moving stroke is hard to be affected by the play in the fitting portion and a manufacturing precision of the constituting parts, so that it is possible to keep the accurate idling opening degree of the throttle valve in correspondence to the moving stroke of the lead screw type step motor.

Further, in accordance with the second aspect of the present invention, since the operating arm portion of the throttle valve lever is pressed toward the first locking portion in the forked locking portion of the loosely fitted lever by the spring force of the loosely fitted lever spring in cooperation with the spring force of the throttle valve return spring, in a state in which the throttle valve is opened further than the idling opening degree and the first idling opening degree of the throttle valve, it is possible to more securely make the throttle valve lever to follow to the rotation in the closing direction of the loosely fitted lever, at a time of the operation in the closing direction of the throttle valve opening drum.

Further, since the loosely fitted lever is pressed in the counterclockwise direction by the loosely fitted lever spring on the basis of the throttle valve lever, it is possible to absorb the play of the fitting portion in the second link shaft portion between the loosely fitted lever and the link lever, and it is possible to accurately transmit the rotation of the throttle valve operating drum toward the loosely fitted lever with no dispersion.

Further, in accordance with the third aspect of the present invention, since the drum shaft, the throttle valve shaft and the cam shaft are arranged so as to stand together on the control main body, it is possible to accurately provide the drum shaft hole supporting the drum shaft and the cam shaft hole supporting the cam shaft on the basis of the throttle valve shaft hole supporting the throttle valve shaft, and it is possible to accurately arrange a mutual pitch among the drum shaft, the throttle valve shaft and the cam shaft supported thereto.

Accordingly, it is possible to accurately transmit the rotation of the throttle valve operating drum to the throttle valve lever via the link and the loosely fitted lever, and it is possible to accurately transmit the rotation of the cam lever to the throttle valve lever.

DESCRIPTION OF THE PREFERRED EMBODIMENT

Figure 1:
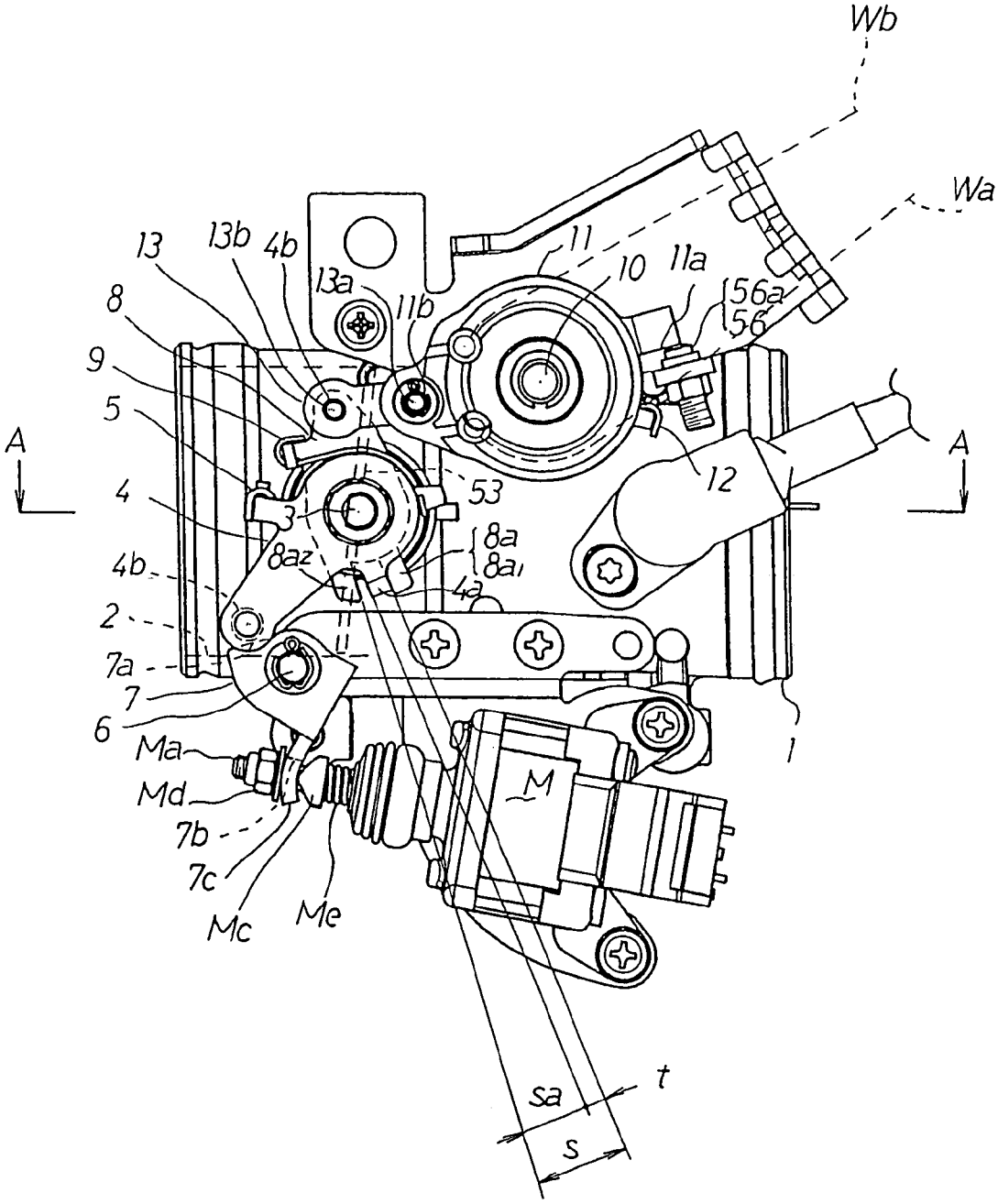
FIG. 1 is a side view showing an embodiment of an idling opening degree control apparatus in an intake air control apparatus in accordance with the present invention.
Figure 2:
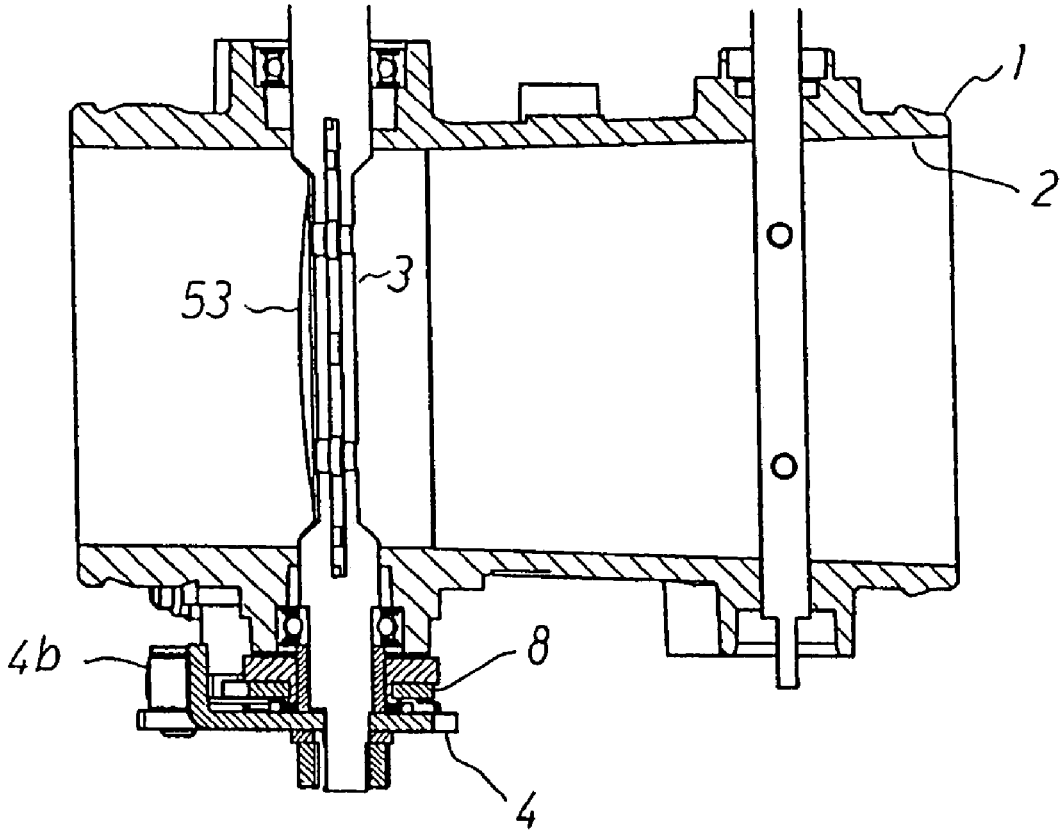
FIG. 2 is a cross sectional view of a main portion along a line A—A in FIG. 1.

A description will be given of an embodiment of an idling opening degree control apparatus in an intake air control apparatus in accordance with the present invention with reference to the accompanying drawings.

Reference numeral 1 denotes a control main body in which an intake passage 2 is provided so as to extend through an inner portion. A throttle valve shaft 3 is rotatably supported to the control main body 1 across the intake passage 2.

A butterfly type throttle valve 53 arranged within the intake passage 2 to open and close the intake passage 2 is integrally attached to the throttle valve shaft 3, and the throttle valve 53 opens the intake passage 2 by rotating in a clockwise direction, and closes the intake passage 2 by rotating in a counterclockwise direction.

One end of the throttle valve shaft 3 is arranged so as to protrude toward an outer side from a side wall of the control main body 1, and a throttle valve lever 4 is integrally attached to the protruding end portion.

The throttle valve lever 4 and the throttle valve shaft 3 are synchronously rotated. Further, one end of a throttle valve return spring 5 is engaged to the throttle valve lever 4, and the other end thereof is engaged to the control main body 1. Accordingly, a rotating force in a counterclockwise direction in the drawing, that is, in a closing direction of the throttle valve 53 is applied to the throttle valve lever 4 and the throttle valve shaft 3.

Further, an operating arm portion 4*a* constituted by a flat plate curved portion extending in a downward direction in the drawing is formed in the throttle valve lever so as to protrude therefrom, and a cylindrical roller 4*b* is arranged in an arm portion in a lower side of the throttle valve lever 4.

Reference numeral 6 denotes a cam shaft pressure inserted to a cam shaft hole provided in the control main body 1. A cam lever 7 is arranged in the cam shaft 6 so as to be rotatably supported.

In the cam lever, there are formed a cam surface 7*a* facing to the roller 4*b* of the throttle valve lever 4, and an arm portion 7*c* in which a forked groove 7*b* for an output shaft Ma of a lead screw type step motor M mentioned below being inserted thereto is provided.

The lead screw type step motor M, which is known one, is firmly fixed to the control main body 1, and a moving stroke in an axial direction of the output shaft Ma is controlled on the basis of an electric signal input to the motor portion.

A screw portion in a leading end of the output shaft Ma is arranged so as to be inserted into the forked groove 7*b* of the cam lever 7, a support body Mc arranged so as to be movably inserted to the output shaft Ma is arranged so as to face to a lower surface of the arm portion 7*c*, a nut Md screwed into the output shaft Ma is arranged so as to face to an upper surface of the arm portion 7*c*, and the support body Mc mentioned above is pressed to the lower surface of the arm portion 7*c* by a support body spring Me.

In other words, the output shaft Ma is arranged so as to be inserted into the groove 7*b* of the arm portion 7*c* in the cam lever 71 and the arm portion 7*c* is pinched by the support body Mc and the nut Md.

Accordingly, the movement in the axial direction of the output shaft Ma of the lead screw type step motor M is directly transmitted to the arm portion 7*c*, and rotates the cam lever 7 in correspondence to the moving stroke in the axial direction of the output shaft Ma.

Reference numeral 8 denotes a loosely fitted lever which is arranged so as to be loosely fitted to the valve shaft 3 and is rotatably arranged in an outer periphery of the throttle valve shaft 3. A forked locking portion 8*a* in a fork shape is formed in the loosely fitted lever 8, and an opposing gap S is formed between a first locking portion 8*a*1 and a second locking portion 8*a*2 forming the forked locking portion 8*a*.

A width of the opposing gap S is formed larger than a width t of the operating arm portion 4*a* of the throttle valve lever 4.

In other words, both ends of the operating arm portion 4*a* are not simultaneously brought into contact with the first locking portion 8*a*1 and the second locking portion 8*a*2. A gap is always formed in both ends of the operating arm portion 4*a* or any one end of the operating arm portion 4*a*.

Further, a second link hole 4*c* for inserting a link shaft mentioned below is provided through in the loosely fitted lever 8.

Further, a loosely fitted lever spring 9 is arranged in a periphery of the throttle valve shaft 3, one end of the loosely fitted lever spring 9 is engaged to the loosely fitted lever 8, the other end thereof is engaged to the throttle valve lever 4, and the loosely fitted lever spring 9 presses the throttle valve lever 4 in a counterclockwise direction in the drawing.

In other words, the loosely fitted lever spring 9 presses the operating arm portion 4*a* of the throttle valve lever 4 toward the first locking portion 8*a*1 of the forked locking portion 8*a*.

In this case, the spring force of the loosely fitted lever spring 9 may be set to an extremely weak spring force in comparison with the spring force of the throttle valve lever spring 5.

This is because the rotating force in the closing direction of the throttle valve lever 4 is mainly applied by the throttle valve lever spring 5.

Reference numeral 10 denotes a drum shaft provided so as to stand on the control main body 1. A throttle valve operating drum 11 is rotatably arranged in an outer periphery of the drum shaft 10.

A rotating force in a clockwise direction in the drawing is applied to the throttle valve operating drum 11 by a drum return spring 12, one end of the drum return spring 12 is engaged to the throttle valve operating drum 11, and the other end thereof is engaged to the control main body 1.

Further, a valve opening wire Wa and a valve closing wire Wb are engaged to the throttle valve operating drum 11, the throttle valve operating drum 11 is rotated in a counterclockwise direction against a spring force of the drum return spring 12 by drawing the valve opening wire Wa, and the throttle valve operating drum 11 is rotated in a clockwise direction by drawing the valve closing wire Wb. Further, a first link hole 11*b* is provided in the throttle valve operating drum 11.

In this case, reference numeral 56 denotes a minimum opening degree regulating member arranged in the control main body 1 by screwing. A leading end 56*a* of the minimum opening degree regulating member 56 is arranged so as to face to an end surface 11*a* of the throttle valve operating drum 11.

Reference numeral 13 denotes a link lever coupling the throttle valve operating drum 11 and the loosely fitted lever 8. A first link shaft 13*a* and a second link shaft 13*b* are provided so as to stand on both ends of the link lever 13.

Further, the first link shaft 13*a* is inserted to a first link hole 11*b* of the throttle valve operating drum 11, and the second link shaft 13*b* is inserted to the second link hole 4*c* of the loosely fitted lever 8, whereby the throttle valve operating drum 11 and the loosely fitted lever 8 are coupled via the link lever 13.

Next, a description will be given of an operation thereof.

A state shown in FIG. 1 corresponds to an engine stop state, in which no drawing motion is applied to the valve opening wire Wa and the valve closing wire Wb, and the lead screw type step motor M is not in operation.

In this state, the end surface 11*a* of the throttle valve operating drum 11 is brought into contact with the leading end 56*a* of the minimum opening degree control member 56, and the minimum opening degree position of the throttle valve operating drum 11 is determined.

The minimum opening degree position state of the throttle valve operating drum 11 is mechanically transmitted to the loosely fitted lever 8 via the link lever 13, whereby the position of the loosely fitted lever 8 is determined. At this time, the throttle valve lever 4 is energized in the counterclockwise direction by the spring force of the throttle valve return spring 5, and the right end of the operating arm portion 4*a* of the throttle valve lever 4 is brought into contact with the first locking portion 8*a*1 of the forked locking portion 8*a* in the loosely fitted lever 8, whereby the position of the throttle valve lever 4 is determined.

In accordance with the structure mentioned above, in the engine stop state, the throttle valve 53 is held at a position of the minimum opening degree in the closing side than the normal idling opening degree.

Further, a gap Sa is formed and held between the left end of the operating arm portion 4*a* of the throttle valve lever 4 and the second locking portion 8*a*2 of the forked locking portion 8*a*.

Further, a gap is formed between the cam surface 7*a* of the cam lever 7 and the roller 4*b*, and the cam surface 7*a* and the roller 4*b* are not brought into contact with each other.

Next, a description will be given of the engine start.

When turning on an ignition switch so as to start the engine, an electric signal in correspondence to an engine ambient atmosphere state such as an engine temperature state, an outside air temperature and the like is input to the lead screw type step motor M from an ECU, for example, and the lead screw type step motor M is operated on the basis of the electric signal, and the output shaft Ma is extended to a left side in the drawing.

In accordance with the operation of the output shaft Ma of the lead screw type step motor M mentioned above, the cam lever 7 is rotated in the clockwise direction in correspondence to the elongation of the output shaft Ma, and the cam surface 7*a* of the cam lever 7 is brought into contact with the roller 4*b* so as to press, and rotates the throttle valve lever 4 in the clockwise direction in correspondence to the elongation of the output shaft of the lead screw type step motor M.

The rotation of the throttle valve lever in the clockwise direction is executed in a range of the gap Sa formed between the left end of the operating arm portion 4*a* and the second locking portion 8a2 of the forked locking portion 8a, but the left end of the operating arm portion 4a is prevented from being brought into contact with the second locking portion 8a2 at a time of operating the lead screw type step motor M.

Figure 3:
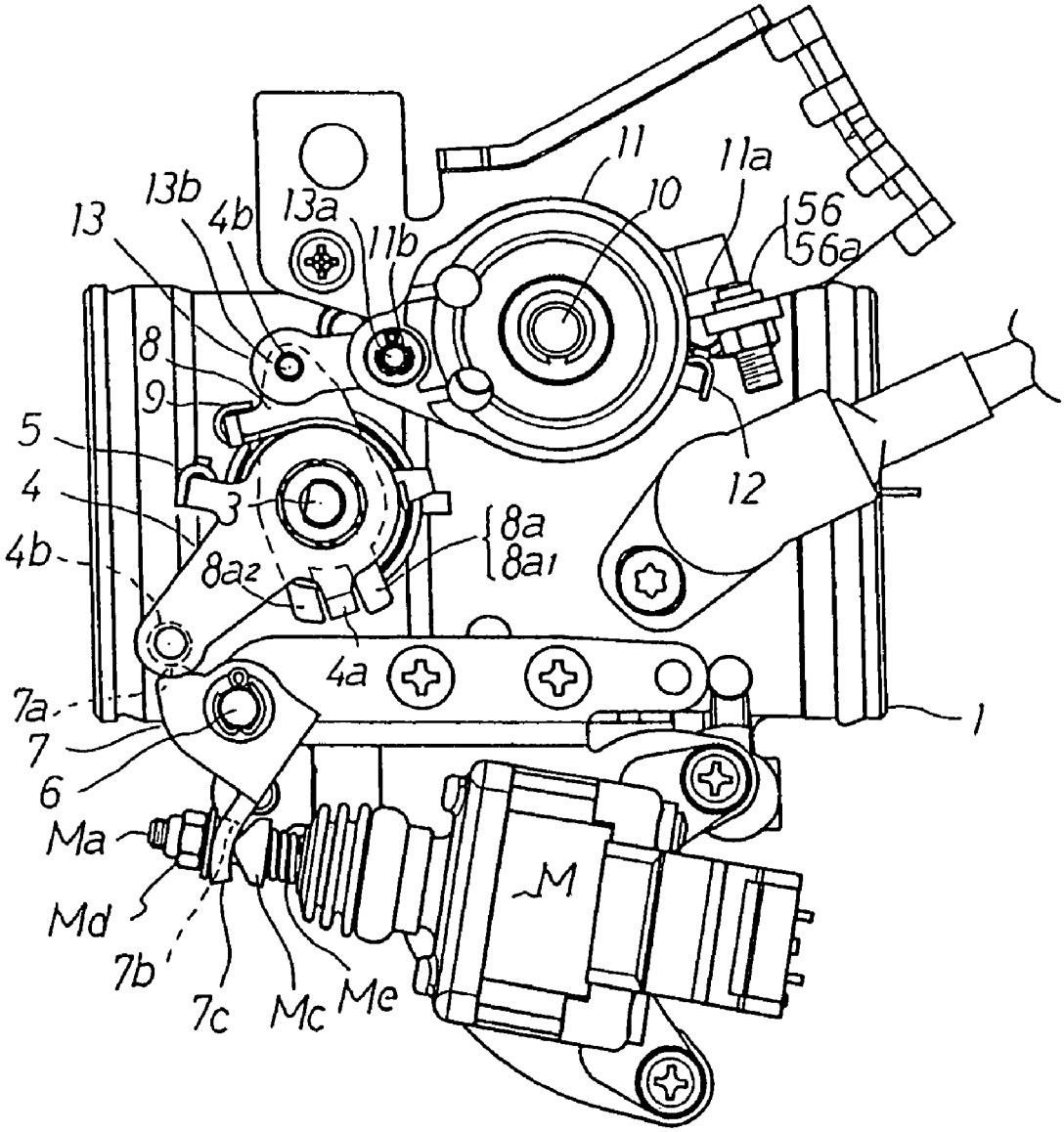
FIG. 3 is a side view of the idling opening degree control apparatus in FIG. 1 at a time of controlling the idle opening degree.
Figure 4:
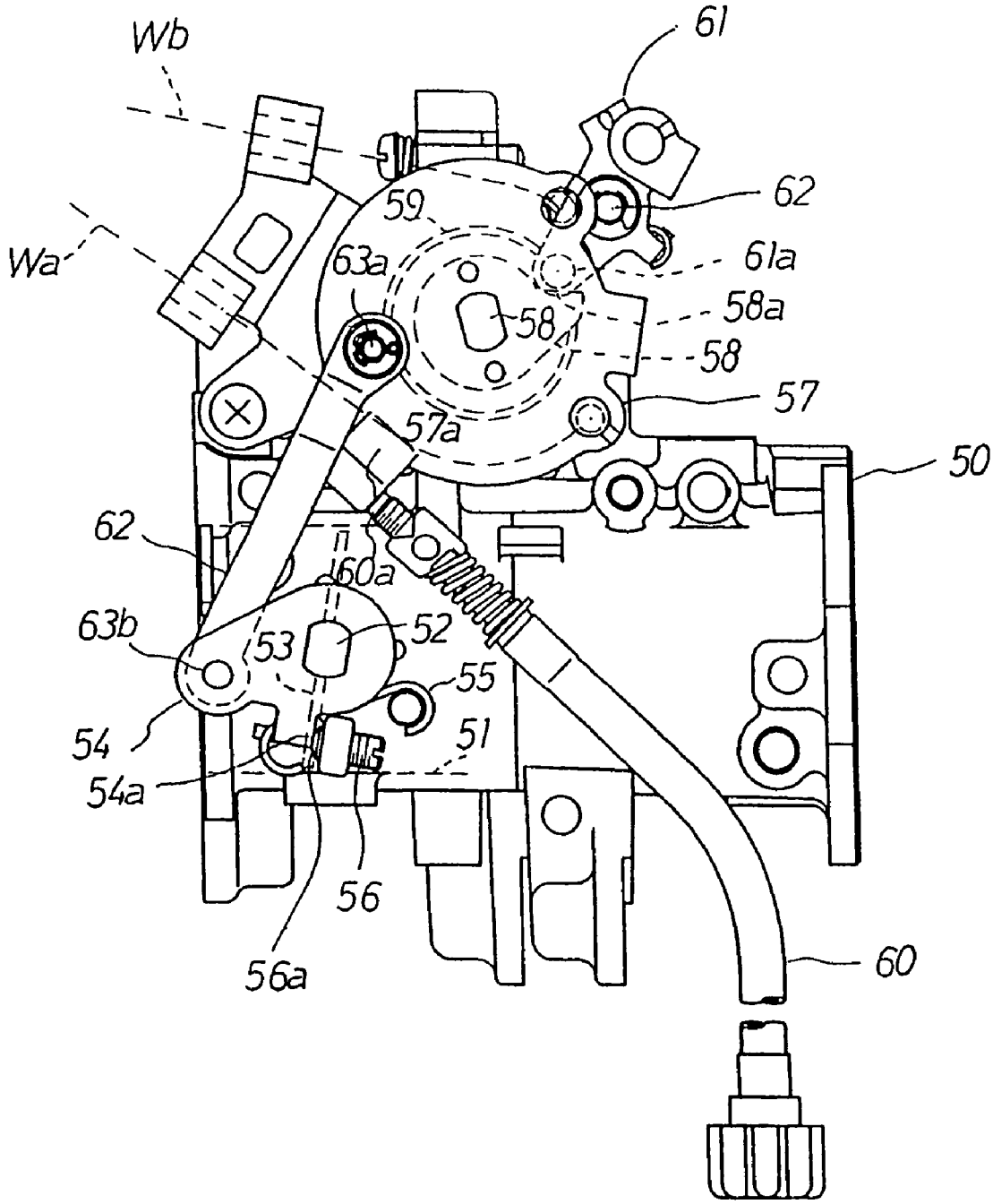
FIG. 4 is a side view of a conventional idling opening degree control apparatus.

In accordance with the structure mentioned above, the throttle valve 53 opens the intake passage in correspondence to the elongation of the output shaft of the lead screw type step motor M in the ON state of the ignition switch, and keeps a desired idling opening degree or a first idling opening degree which is opened further than the normal idling opening degree. This state is shown in FIG. 3.

Next, the engine is started by driving a starter motor. In the state mentioned above, since the throttle valve 53 is held in the idling opening degree or the first idling opening degree, it is possible to securely execute the idling operation or the first idling operation of the engine.

Further, the opening motion of the throttle valve 53 is executed by drawing the valve opening wire Wa.

In other words, when the driver draws the valve opening wire Wa, the throttle valve operating drum 11 is rotated in the counterclockwise direction against a spring force of the drum return spring 12.

Further, the rotation of the throttle valve operating drum 11 is transmitted to the loosely fitted lever 8 via the link lever 13 so as to rotate the loosely fitted lever 8 in the clockwise direction.

In accordance with the rotation in the clockwise direction of the loosely fitted lever 8, the first locking portion 8a1 of the forked locking portion 8a is brought into contact with the right end of the operating arm portion 4a, and the throttle valve lever 4 is rotated in the clockwise direction in synchronous with the rotation of the loosely fitted lever 8 against the spring force of the throttle valve return spring 5, whereby the throttle valve 53 is opened in correspondence to the rotation of the throttle valve operating drum 11.

On the other hand, the closing motion of the throttle valve 53 is executed by drawing the valve closing wire Wb.

In other words, when the driver draws the valve closing wire Wb, the throttle valve operating drum 11 is rotated in the clockwise direction.

Further, the rotation of the throttle valve operating drum 11 is transmitted to the loosely fitted lever 8 via the link lever 13 so as to rotate the loosely fitted lever 8 in the counterclockwise direction.

In accordance with the rotation in the counterclockwise direction of the loosely fitted lever 8, the throttle valve lever 4 is rotated in the counterclockwise direction in synchronous with the rotation of the loosely fitted lever 8 by the spring force of the throttle valve return spring 5 in a state in which the first locking portion 8a1 of the forked locking portion 8a is brought into contact with the right end of the operating arm portion 4a, whereby the throttle valve is closed in correspondence to the rotation of the throttle valve operating drum 11.

Further, the rotation of the throttle valve lever 4 in the counterclockwise direction is stopped in a state in which the roller 4b of the throttle valve lever 4 is brought into contact with the cam surface 7a of the cam lever 7, and the idling opening degree or the first idling opening degree of the throttle valve 53 is held.

In accordance with the idling opening degree control apparatus on the basis of the present invention having the structure mentioned above, the idling opening degree or the first idling opening degree of the throttle valve 53 is controlled by the lead screw type step motor M, and the coupling relation to the throttle valve operating drum 11 is interrupted at this time.

Accordingly, when the lead screw type step motor M is driven so as to rotate the cam lever 7 and the throttle valve lever 4, the operating arm portion 4a of the throttle valve lever 4 moves within the opposing gap S of the forked locking portion 8a in the loosely fitted lever 8, whereby it is sufficient that the lead screw type step motor M is driven against the spring force of the throttle valve return spring 5.

In other words, the lead screw type step motor M is not affected by the spring force of the drum return spring 12.

In accordance with the structure mentioned above, it is possible to lower the driving force of the lead screw type step motor M, whereby it is possible to make the motor compact and lower the electric power consumption of the motor, and the structure is effective particularly in a machine in which a receiving space is limited or an electric capacity is small, such as a two-wheel vehicle.

Further, since the idling opening degree and the first idling opening degree of the throttle valve 53 mentioned above are controlled between the cam surface 7a of the cam lever 7 and the roller 4b of the throttle valve lever 4, it is possible to reduce the constituting parts relating to the control and the coupling means constituted by the fitting portion such as the link or the like is not provided, whereby it is possible to accurately and uniformly control the opening degree and it is possible to reduce a durability deterioration during long time use.

Further, since the loosely fitted lever spring 9 pressing the operating arm portion 4a of the throttle valve lever 4 toward the first locking portion 8a1 of the forked locking portion 8a in the loosely fitted lever 8 is provided compressedly between the throttle valve lever 4 and the loosely fitted lever 8, it is possible to more securely make the throttle valve lever 4 follow toward the loosely fitted lever 8 at a time when the throttle valve operating drum 11 is moved in the closing direction.

Further, since the throttle valve shaft 3, the drum shaft 10 and the cam shaft 6 are supported by the control main body 1, it is possible to accurately arrange the drum shaft 10 and the cam shaft 6 on the basis of the throttle valve shaft 3 having a long bearing distance across the intake passage 2, and it is possible to accurately arrange the throttle valve operating drum 11 and the cam lever 7 with respect to the loosely fitted lever 8 and the throttle valve lever 4.

What is claimed is:

1. An idling opening degree control apparatus in an intake air control apparatus in which an intake passage provided through in a control main body is opened and closed by a throttle valve attached to a throttle valve shaft rotatably pivoted to the control main body, comprising:

a throttle valve lever (4) firmly fixed to a throttle valve shaft (3) and synchronously rotating with the throttle valve shaft (3);

a loosely fitted lever (8) rotatably arranged in the throttle valve shaft (3) in a loose fit manner;

a throttle valve operating drum (11) rotatably supported to a drum shaft (10) and operated so as to be opened and closed by a driver; and a cam lever (7) rotatably pivoted to a cam shaft (6) and rotating in correspondence to a movement in an axial direction of a lead screw type step motor (M), wherein said throttle valve operating drum and the loosely fitted lever (8) are coupled via a link lever (13), wherein an operating arm portion (4a) formed in said throttle valve lever is arranged so as to face to an opposing gap (S) between a first locking portion (8*a*1) and a second locking portion (8*a*2) in a forked locking portion (8*a*) formed in the loosely fitted lever (8) and a cam surface (7*a*) of the cam lever (7) is arranged so as to face to a roller (4*b*) provided in the throttle valve lever (4), wherein the operating arm portion (4*a*) of the throttle valve lever (4) is moved within the opposing gap (S) between the first locking portion (8*a*1) and the second locking portion (8*a*2) in the forked locking portion (8*a*) by the cam lever (7), thereby keeping an idling opening degree or a first idling opening degree of the throttle valve, at a time of operating the reed screw type stepping motor (M), and wherein the throttle valve is opened by bringing the first locking portion (8*a*1) of the loosely fitted lever (8) into contact with the operating arm portion (4*a*) of the throttle valve lever (4), at a time of operating the throttle valve operating drum (11) in an opening direction.

2. An idling opening degree control apparatus as claimed in claim 1, wherein a loosely fitted lever spring (9) pressing the operating arm portion (4*a*) of the throttle valve lever (4) toward the first locking portion (8*a*1) of the loosely fitted lever (8) is provided compressedly between said throttle valve lever and the loosely fitted lever (8).

3. An idling opening degree control apparatus as claimed in claim 1, wherein said drum shaft, the throttle valve shaft (3) and the cam shaft (6) are supported by the control main body (1).

* * * * *